US006892557B2

(12) United States Patent
Bieniek

(10) Patent No.: US 6,892,557 B2
(45) Date of Patent: May 17, 2005

(54) LOCK

(75) Inventor: Jerzy Michal Bieniek, Roodepoort (ZA)

(73) Assignee: Piotr Leonard Kowalczyk, Roodeport (ZA)

( * ) Notice: Subject to any disclaimer, the term of this patent is extended or adjusted under 35 U.S.C. 154(b) by 0 days.

(21) Appl. No.: 10/362,501

(22) PCT Filed: Aug. 17, 2001

(86) PCT No.: PCT/IB01/01485

§ 371 (c)(1),
(2), (4) Date: Aug. 15, 2003

(87) PCT Pub. No.: WO02/16714

PCT Pub. Date: Feb. 28, 2002

(65) Prior Publication Data

US 2004/0025551 A1 Feb. 12, 2004

(30) Foreign Application Priority Data

Aug. 22, 2000 (ZA) ..... 2000/4317

(51) Int. Cl.[7] ..... E05B 49/00
(52) U.S. Cl. ..... 70/278.7; 70/278.2; 70/283.1
(58) Field of Search ..... 70/277, 278.1, 70/278.2, 278.7, 283.1, 183, 187, 188, 189, 222, 223, 279.1, 283

(56) References Cited

U.S. PATENT DOCUMENTS

| | | | | |
|---|---|---|---|---|
| 3,748,878 A | | 7/1973 | Balzano et al. | 340/5.54 |
| 4,411,144 A | * | 10/1983 | Aydin | 70/278.2 |
| 4,882,529 A | | 11/1989 | Kobari et al. | |
| 5,406,077 A | | 4/1995 | Aoki et al. | |
| 5,552,777 A | | 9/1996 | Gokcebay et al. | 70/218 |
| 5,640,863 A | * | 6/1997 | Frolov | 70/283 |
| 5,694,798 A | * | 12/1997 | Nunez et al. | 70/283 |
| 6,334,347 B1 | * | 1/2002 | Iscla | 70/278.3 |
| 6,334,348 B1 | * | 1/2002 | Ming-Chih | 70/472 |
| 6,412,321 B1 | * | 7/2002 | Aramburu et al. | 70/278.3 |
| 6,677,844 B1 | * | 1/2004 | Gorospe et al. | 335/220 |

FOREIGN PATENT DOCUMENTS

| | | |
|---|---|---|
| DE | 44 10 955 A1 | 10/1994 |
| DE | 196 03 320 A1 | 8/1997 |
| EP | 0 293 479 A1 | 12/1988 |
| EP | 0 428 892 A2 | 5/1991 |
| EP | 0 661 543 | 7/1995 |
| FR | 2 607 545 A1 | 6/1988 |
| WO | WO 9602721 A1 | 2/1996 |

OTHER PUBLICATIONS

D. Mann, "Verbesserte Auswertung von Inkrementellen Gebersystemen durch Overcampling," published at ISW Lageregelseminar entitled "Fortschritte in der Regelungs" held Nov. 13–14, 1998, pp. 1–20.

* cited by examiner

*Primary Examiner*—John B. Walsh
(74) *Attorney, Agent, or Firm*—Brinks Hofer Gilson & Lione

(57) ABSTRACT

The invention is in respect of a lock having a body and an actuator arrangement which is displaceable relative to the body between an inoperative condition and an operative condition. The actuator arrangement is capable of operating a device such as a locking mechanism or the like only when in its operative condition. The lock further includes non-mechanical key identification means. The lock further includes retaining means for retaining the actuator arrangement releasably in its inoperative condition. The retaining means is linked to the key identification means and operative in response to a signal received therefrom to permit displacement of the actuator arrangement to its operative condition. The actuator arrangement typically includes an inner member, an outer member and a coupling whereby the inner and outer member are coupled together to permit relative longitudinal displacement between the inner and outer member and inhibit relative rotational movement.

20 Claims, 5 Drawing Sheets

LOCK

Applicant claims, under 35 U.S.C. §§120 and 365, the benefit of priority of the filing date of Aug. 17, 2001 of a Patent Cooperation Treaty patent application, copy attached, Serial Number PCT/IB01/01485, filed on the aforementioned date, the entire contents of which are incorporated herein by reference, wherein Patent Cooperation Treaty patent application Serial Number PCT/IB01/01485 was published under PCT Article 21(2) in English.

Applicant claims, under 35 U.S.C. §119, the benefit of priority of the filing date of Aug. 22, 2000 of a South African patent application, copy attached, Ser. No. 2000/4317, filed on the aforementioned date, the entire contents of which are incorporated herein by reference.

THIS INVENTION relates to a lock. It further relates to an actuator arrangement, to a lock set and to a key According to one aspect of the invention there is provided a lock which includes a body;

an actuator arrangement which is displaceable relative to the body between an inoperative condition in which it is incapable of operating a device and an operative condition from which it is capable of operating a said device;

non-mechanical key identification means; and retaining means for retaining the actuator arrangement releasably in its inoperative condition, the retaining means being linked to the key identification means and operative in response to a signal received therefrom to permit displacement of the actuator arrangement to its operative condition.

The Inventor believes that in the primary application of the invention the device which the actuator arrangement will be capable of operating will be a lock mechanism and this is the application which will be borne in mind herebelow. However, the Inventor believes that the lock may find other applications, eg the device which the actuator arrangement is capable of operating could be a switch.

Hence, when the actuator arrangement is retained by the retaining means in its inoperative condition displacement of the actuator arrangement relative to the body will not operate a said device, e.g. a lock mechanism, however, once the actuator arrangement has been displaced to its operative condition relative displacement between the actuator arrangement and the body is capable of operating a said lock mechanism. One way in which this can be achieved is drivingly connecting the actuator arrangement to a said lock mechanism when the actuator arrangement is in its operative condition and disconnecting the actuator arrangement from a said lock mechanism when the actuator arrangement is in its inoperative condition.

The key identification means may include electronic control circuitry and communication means whereby the control circuitry can communicate with an encoded key to permit identification of the key by the control circuitry.

The communication means may be configured to permit wireless communication between the control circuitry and a key. Instead or in addition the communication means may include at least one electrical contact which is connected to the electronic control circuitry and is mounted on the body for making contact with a complementary contact on an electronically encoded key.

The actuator arrangement may be mounted for displacement, relative to the body both rotatably about an axis of rotation and longitudinally between a first position, towards which it is biassed by a first biassing means, and a second position, the retaining means being displaceable, in response to a signal received from the key identification means, from a rest position, towards which it is biassed, and in which it inhibits longitudinal displacement of at least part of the actuator arrangement away from its first position, to a displaced position in which it permits displacement of the actuator arrangement longitudinally to its second position.

The actuator arrangement may include an outer member which is mounted for both longitudinal and rotational displacement relative to the body, an inner member mounted axially in register with the outer member and a coupling configured to permit limited relative longitudinal movement of the outer member and the inner member and to transmit torque applied from the outer member to the inner member.

The retaining means may act on one of the coupling and the inner member such that when the retaining means is in its rest position it permits the displacement of the outer member longitudinally towards the inner member and inhibits its displacement of the inner member at least longitudinally.

In one embodiment of the invention the coupling includes an open ended sleeve within which adjacent end portions of the inner and outer members are positioned, the sleeve and the inner and outer members having complementary formations which permit limited longitudinal displacement of the inner and outer members relative to each other and which inhibits relative rotational movement between the inner and outer members.

The complementary formations may include pins which protrude radially outwardly from the inner and outer members and are slidable in a longitudinal slot in the sleeve.

The retaining means may include at least one displaceable locking member which, in its rest position, engages the sleeve to inhibit displacement thereof, at least longitudinally, and displacement means for displacing the locking member from its rest position to a displaced position in which it permits displacement of the sleeve.

The displacement means may include a solenoid.

The retaining means may include a pair of locking members.

In another embodiment of the invention the coupling includes an axially extending socket provided in and opening out of an end of one of the inner member and the outer member and a complementary spigot protruding axially from an end of the other of the inner member and outer member, at least part of the spigot being positioned within the socket, the spigot being longitudinally displaceable in the socket and the coupling being configured to inhibit rotation of the spigot in the socket and thereby permit the transmission of torque from the outer member to the inner member.

The spigot may have a longitudinally extending recess in a surface thereof, the coupling including a retaining pin which extends transversely through the socket and the recess to inhibit rotation of the spigot in the socket.

Typically the socket is provided in the outer member and the spigot is provided on the inner member.

The first biassing means may include a first coil spring mounted in compression between the body and the outer member and urging the outer member towards a key entry point in the body, i.e. towards its first position.

The lock may include second bias means urging the inner and outer members away from one another.

The second bias means may include a second coil spring mounted in compression between the inner and outer members.

According to another aspect of the invention there is provided a lock which includes a body; and an actuator arrangement, at least part of which is displaceable relative to the body longitudinally between a first position towards which it is biassed and a second position and rotatably at least when in its second position.

The actuator arrangement may include an outer member which is mounted on the body for both longitudinal and rotational displacement, an inner member mounted axially in register with the outer member and a coupling configured to permit limited relative longitudinal movement of the outer member and the inner member and to transmit torque from the outer member to the inner member.

The body may include a key entry point, longitudinal displacement of the outer member away from its first position being effected by insertion of a key into the key entry point.

The lock may include a plurality of electrical contacts on the body, each contact being in the form of an electrically conductive pin positioned in a recess in the body.

The lock may include electrically powered components the power for which is supplied, in use, from a power source in a key, power being transmitted from a said key to the components of the lock through electrical contacts on the body.

The lock may include an internal power source.

According to yet another aspect of the invention there is provided a lock which includes a key operated actuator arrangement; and non mechanical key identification means linked to the actuator arrangement and configured to permit the key to be drivingly connected to at least part of the actuator arrangement only once the key has been positively identified.

The invention further provides an actuator arrangement which includes a first member which is displaceable between a rest position towards which it is biassed and a displaced position;

a second member which is displaceable between a rest position to which it is biassed and a displaced position;

urging means configured, when the first member is displaced to its displaced position to urge the second member towards its displaced position; and retaining means for retaining the second member releasably in its rest position.

The first and second members may be longitudinally aligned, the actuator arrangement including a coupling which is configured to permit limited relative longitudinal movement of the first and second members and to transmit torque between the first and second members.

The Inventor believes that the actuator will find application particularly as part of a lock, however, it may be suitable for other applications.

The invention extends further to a lock which includes an actuator arrangement as described above; and non-mechanical key identification means to which the retaining means is linked so that it is operative in response to a signal received from the key identification means to permit displacement of the second member to its displaced position.

According to yet another aspect of the invention th re is provided a lock set which includes a lock as described above; and a complementary key.

The key may be electronically encoded and include a power source.

The invention extends to a key for use in a lock set as described above.

The invention will now be described, by way of example, with reference to the accompanying diagrammatic drawings.

Figure 1:
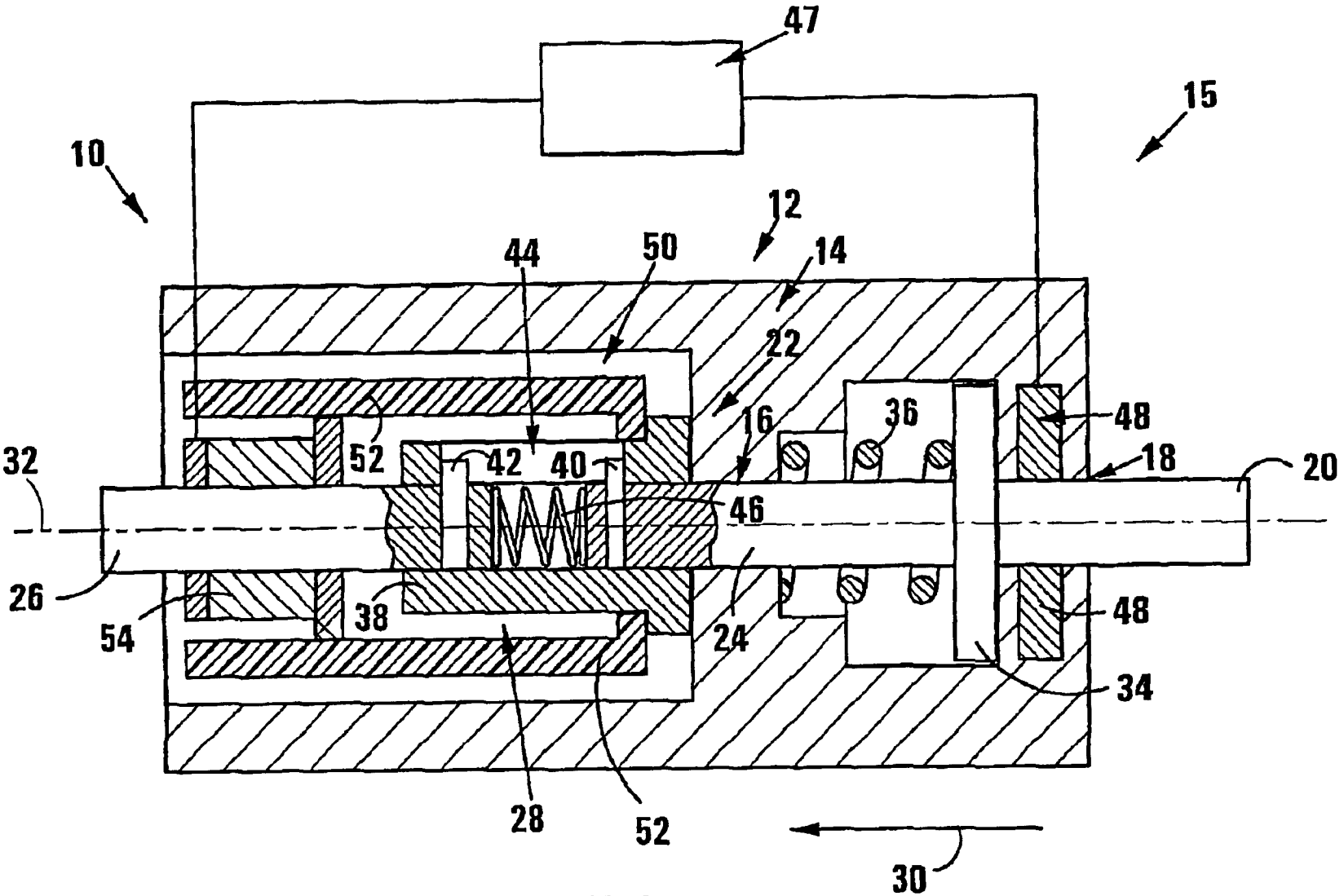
FIG. 1 shows a schematic sectional representation of part of a lock in accordance with the invention an actuator arrangement of which is shown in a first or inoperative condition.
Figure 2:
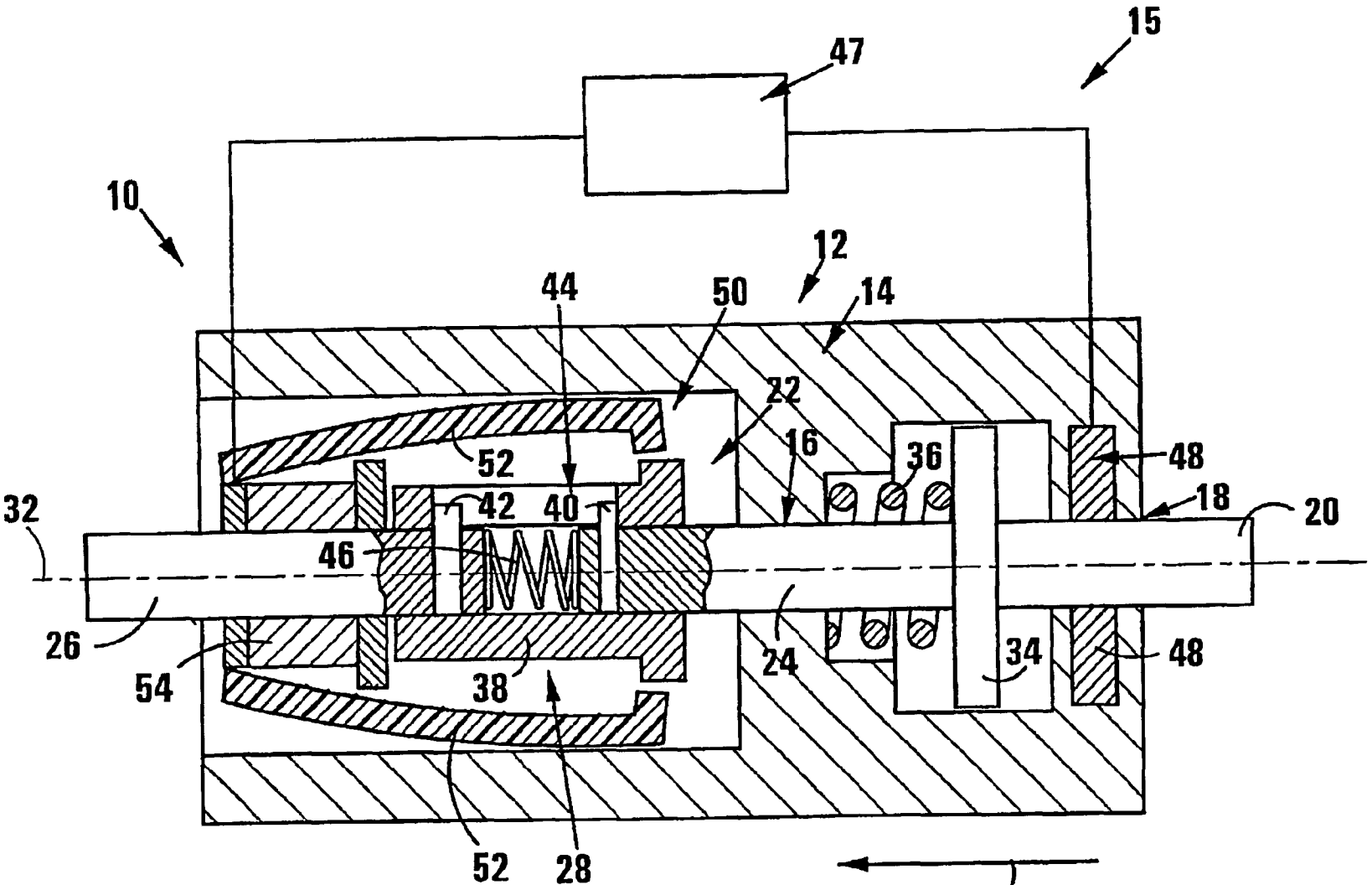
FIG. 2 shows a schematic sectional representation similar to FIG. 1 with the actuator arrangement of the lock in a second or operative condition.

In FIGS. 1 and 2 of the drawings, reference numeral 10 refers generally to a lock in accordance with the invention. The lock 10 includes a body or housing, part of which is shown in the drawings and is generally indicated by reference numeral 12. The lock further includes a key operated actuator arrangement, generally indicated by reference numeral 22 and non-mechanical key identification means, part of which is generally indicated by reference numeral 15.

The body 12 includes a passage 16 extending longitudinally therethrough and opening out of opposed ends of the body 12. One end of the passage defines a key entry point or keyhole 18 whereby a key 20 can be inserted.

The actuator arrangement 22 includes an elongate outer member 24, an elongate inner member 26 and a coupling 28 connecting the inner and outer members 26, 24, together as described in more detail here below.

The outer member 24 is mounted in the body 12 for both longitudinal displacement in the direction of arrow 30 and rotational displacement about an axis 32. The outer member 24 includes a stem and a head 34. Bias means in the form of a coil spring 36 is mounted in compression between the head 34 and the body 12 to urge the outer member resiliently towards the keyhole 18.

The coupling 28 includes an open ended sleeve 38 within which adjacent end portions of the outer member 24 and inner member 26 are positioned. A pin 40 protrudes radially outwardly from the portion of the outer member 24 positioned within the sleeve 38 and a pin 42 protrudes radially outwardly from the portion of the inner member 26 positioned within the sleeve 38, the pins 40, 42 being slidably positioned in a longitudinally extending slot 44 in the sleeve 38. Hence, the outer member 24 and inner member 26 are longitudinally displaceable relative to one another and relative to the sleeve 38, however, relative rotation of the outer member 24 and inner member 26 is inhibited. A coil spring 46 is mounted in the sleeve 38 between adjacent ends of the outer member 24 and inner member 26 and urges the outer and inner members 24, 26 away from one another.

The key identification means 15 includes electronic control circuitry, generally indicated by reference numeral 47, and electrical contacts 48 mounted on the body 12 adjacent to the keyhole 18.

The lock 10 includes retaining means, generally indicated by reference numeral 50 which is connected to and operable in response to signals received from the electronic control circuitry 47. The retaining means 50 includes a pair of locking members or pawls 52 which are displaceable by means of a solenoid 54 from a rest position (shown in FIG. 1 of the drawings) towards which they are biassed and in which they engage the sleeve 38 and inhibit displacement thereof and a displaced position (shown in FIG. 2 of the drawings) in which they are clear of the sleeve and permit displacement thereof. It will be appreciated that the locking members can take any suitable form and can be displaced in any suitable fashion, eg by means of an electric motor.

In use, in order to operate the lock 10 the key 20 which is electronically encoded and is provided with electrical contacts, complementary to the contacts 48 is inserted into the keyhole 18. Initially the key 20 is inserted until it abuts against the head 34. Further insertion of the key 20 displaces the outer member 24 in the direction of arrow 30 against the bias of the spring 36 at which position the contacts on the key make electrical contact with the contacts 48. The key incorporates a power source, eg in the form of a battery, which supplies electrical energy, via the contacts, to the electronic control circuitry 47 mounted in or on the body 12. If the electronic control circuitry positively identifies the key 20 then the solenoid 54 is energised, once again from power supplied by the power source in the key, to displace the pawls 52 to their displaced positions clear of the sleeve 38. It will be appreciated, that the initial displacement of the outer member 24 in the direction of arrow 30 serves to bring the inner end of outer member 24 closer to the adjacent end of the inner member 26 thereby compressing the spring 46. Once the pawls 52 are displaced to their displaced positions, the compression of the coil spring 46 acts on the inner member 26 to displace it together with the sleeve 38 in the direction of arrow 30 such that the end of the inner member 26 remote from the outer member 24 is displaced in the direction of arrow 30 into the operative condition shown in FIG. 2. In this position the inner member 26 can drivingly engage further components of the lock e.g. a latch, lock mechanism or the like. In this position, the key 20 can then be displaced, e.g. by being rotated and the mechanical movement of the key is transmitted to the inner member 26 via the outer member 24 and the sleeve 38 permitting mechanical actuation of the latch or lock mechanism. To this end, the key 20 and the outer member 24 will typically be provided with complementary drive formations.

In order to remove the key 20 from the body 12 it will typically be necessary to rotate the key and hence also the outer member 24, inner member 26 and coupling 28 to their original unrotated positions at which the key 20 can be withdrawn through the keyhole 18. The outer member 24 is then urged to its rest position under the influence of the spring 36 which serves to displace the sleeve 38 and inner member 36 in a direction opposite to the direction of arrow 30 so that the pawls 52 can once again engage the sleeve 38 and lock it in position.

Figure 3:
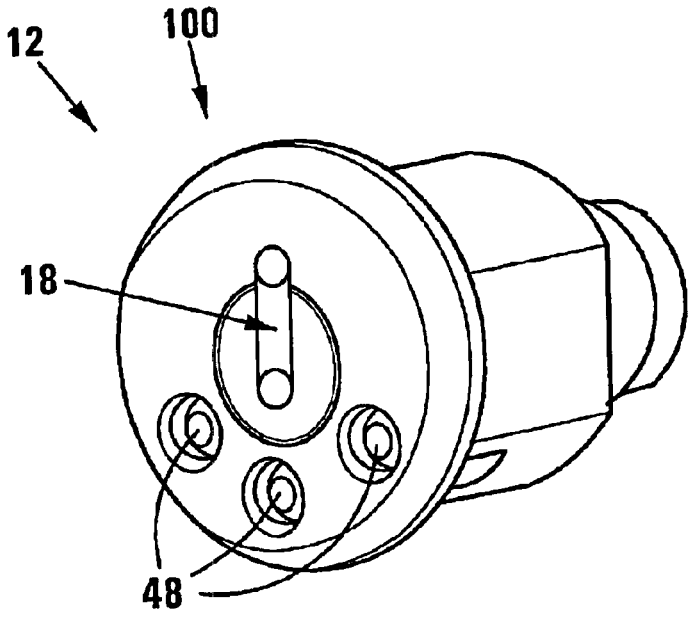
FIG. 3 shows a three-dimensional view of another lock in accordance with the invention.
Figure 4:
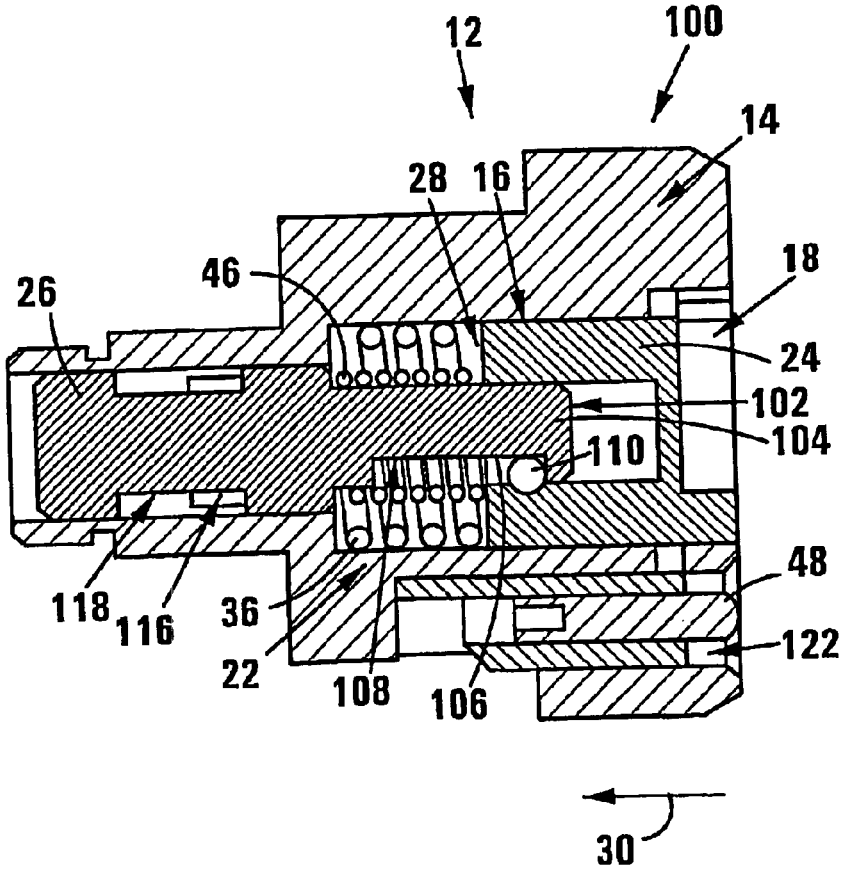
FIG. 4 shows a sectional elevation of the lock of FIG. 3 in its inoperative condition.
Figure 5:
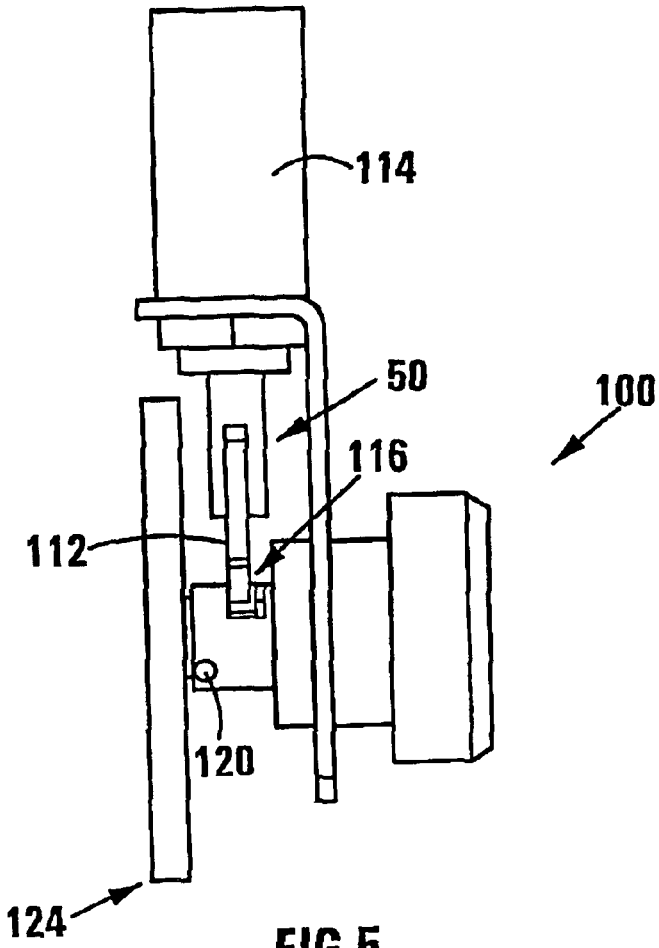
FIG. 5 shows a side view of a lock installation incorporating the lock of FIG. 3 and FIG. 4.

Reference is now made to FIGS. 3 to 5 of the drawings, in which reference numeral 100 refers generally to another lock in accordance with the invention and, unless otherwise indicated, the same reference numerals used above are used to designate similar parts.

In this embodiment of the invention, as can best be seen in FIG. 4, the coupling 28 includes an axially extending socket 102 which opens out of an operatively inner end of the outer member 24. The coupling 28 further includes a complementary spigot 104 which protrudes from the operatively outer end of the inner member 26 and is slidably positioned within the socket 102. The spigot 104 has a longitudinally extending flat 106 formed by a longitudinally extending recess 108 therein. A retaining pin 110 extends transversely across the socket 102 through the recess 108. This arrangement permits limited displacement of the outer member 24 and inner member 26 longitudinally relative to one another and inhibits relative rotational displacement.

As can best be seen in FIG. 5 of the drawings, in this embodiment of the invention, the retaining means 50 includes a retaining pin 112 which is displaceable by means of a solenoid 114 between a rest position (shown in FIG. 5 of the drawings), towards which it is biassed, in which it extends through a hole 116 in the body 12 into engagement with an annular recess 118 in the radially outer surface of the inner member 26 to inhibit longitudinal displacement of the inner member 26 away from its first position shown in FIG. 4 of the drawings and a displaced position in which the retaining pin 112 is withdrawn from the recess 118 and hole 116 to permit longitudinal displacement of the inner member 26 in the direction of arrow 30.

Further, as can best be seen in FIG. 5 of the drawings, a locking pin 120 extends transversely through the body 12 in register with the recess 118 and serves to permit limited longitudinal displacement of the inner member 26 relative to the body 12 whilst holding the inner member 26 captive in the body 12. In view of the fact that the recess 118 is annular, the inner and outer members 26, 24 are freely rotatable relative to the body 12 thereby improving the tamper resistance of the lock.

In addition, in this embodiment of the invention, the contacts 48 are in the form of pins which are positioned within sockets 122 which open out of a front surface of the body 12.

Figure 7:
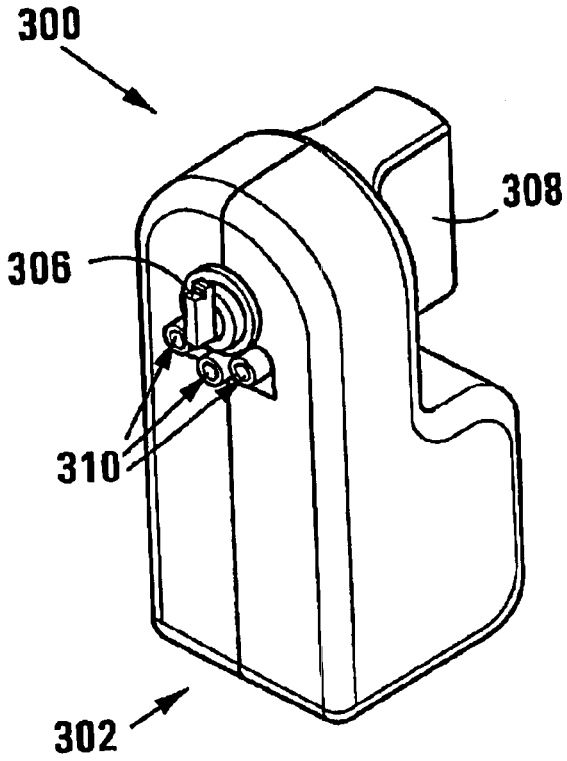
FIG. 7 shows a three-dimensional view of a key in accordance with the invention.
Figure 8:
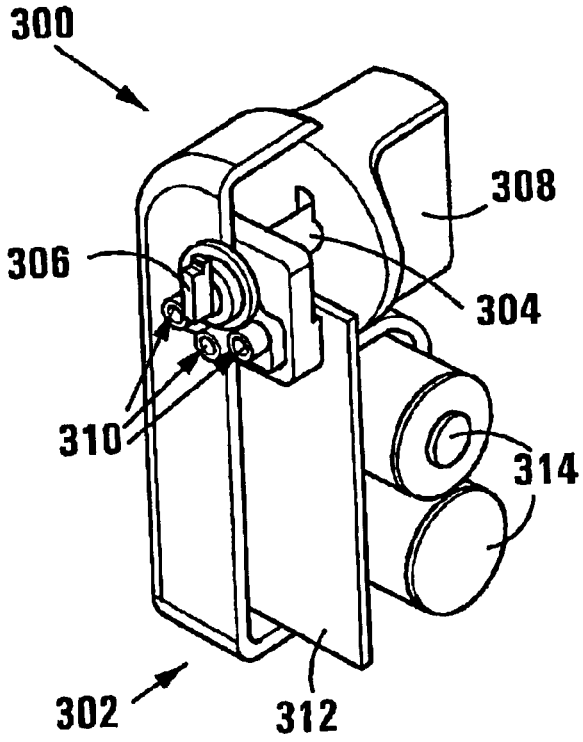
FIG. 8 shows the key of FIG. 7 with one half of the housing removed.

Reference is now made to FIGS. 7 and 8 of the drawings, in which reference numeral 300 refers generally to a key in accordance with the invention. The key 300 includes a hollow body 302 through which a rotatable spindle 304 extends. An outer member engaging formation 306 is provided on one end of the spindle 304 and a handle 308 is provided on the other end of the spindle 304 to facilitate rotation of the spindle 304 and hence the outer member engaging formation 306 relative to the body 302.

Three electrical contacts in the form of sockets 310 are provided on the body 302.

A microprocessor 312 is contained within the body 302 as is a power source in the form of batteries 314.

The key 300 is suitable for use with the lock 100.

In use, the lock 100 is used in substantially the identical fashion to the lock 10. More particularly, the outer member engaging formation 306 of the key 300 is inserted into the key hole 18. Insertion of the formation 306 displaces outer member 24 in the direction of arrow 30 against the bias of the spring 36. As the formation 306 is inserted, the contacts 310 on the key make electrical contact with contacts 48. The batteries 314 supply electrical energy, via the contacts 310, 48, to the electronic control circuit which is not shown in this embodiment. If the electronic control circuitry positively identifies the key, then the solenoid 114 is energized, once again from the power supplied by the power source in the key, to displace the retaining pin 112 to its withdrawn position. It will be appreciated, that the initial displacement of the outer member 24 in the direction of arrow 30 serves to compress the spring 46. Once the retaining pin 112 has been displaced to its withdrawn position, the compression of the coil spring 46 acts on the inner member 26 to displace it in the direction of arrow 30 such that the end of the inner member 26 remote from the outer member 24 is displaced in the direction of arrow 30, the actuator arrangement then being in its operative condition. In this position the end of the inner member 26 remote from the outer member 24 drivingly engages a lock mechanism, part of which is indicated by reference numeral 124 in FIG. 5, and rotation of the handle 308 of the key 300 then permits the lock mechanism to be operated.

In order to remove the key from the body 12 it will typically be necessary to rotate the formation 306 and hence also the outer member 24 and inner member 26 to their original unrotated position at which the formation 306 can be withdrawn through the key hole 18. as the key is withdrawn, the inner and outer members return, under the influence of the springs 36, 46 towards the positions shown in FIG. 4 of the drawings and the retaining pin 112 returns to its rest position in which it is seated in the recess 118.

Figure 6:
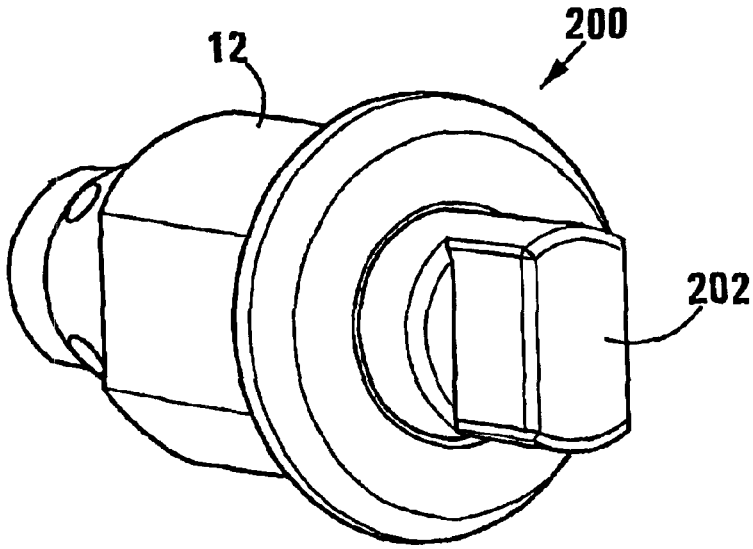
FIG. 6 shows a three-dimensional view of yet another lock in accordance with the invention.

Reference is now made to FIG. 6 of the drawings, in which reference numeral 200 refers generally to another lock in accordance with the invention and, unless otherwise indicated, the same reference numerals used above, are used to designate similar parts.

The lock 200 is similar to the lock 100, the main difference being that, in the case of the lock 200, no key hole is provided. Instead, the outer member 24 includes a non-circular protrusion 202 which protrudes outwardly from the body 12. The protrusion 202 serves as a drive formation which is drivingly engagable by hand or by means of a complementary shaped recess in a key for displacement both axially and rotatably in the manner described above.

In this embodiment instead of making use of electrical contacts to connect the key in communication with the electronic control circuitry 47, the communication may be wireless communication. Naturally, this can be achieved in any suitable fashion, eg with the key and control circuitry having complementary receivers and transmitters. Instead, the key may be magnetically encoded and the control circuitry may include a magnetic reader. Naturally, however, any suitable communication arrangement between the key and the control circuitry could be used.

In addition, both the key and control circuitry are typically programmable providing improved flexibility and control.

Further, the mechanical components of the different locks and keys can be substantially identical with the different software providing them with different functionality. This serves to reduce the cost associated with manufacture. If desired, for example, the key could have time related functionality to permit its use only for a predetermined period of time after which it becomes disabled.

The Inventor believes that a lock in accordance with the invention will be cost effective and provide improved security and convenience in use when compared with existing locks of which the inventor is aware.

What is claimed is:

1. A lock which includes:

a body;

an actuator arrangement which is displaceable relative to the body between an inoperative condition in which it is incapable of operating a device and an operative condition from which it is capable of operating said device;

non-mechanical key identification means; and retaining means for retaining at least part of the actuator arrangement releasably in its inoperative condition, the retaining means being linked to the key identification means and operative in response to a signal received therefrom to permit displacement of the actuator arrangement to its operative condition, the actuator arrangement including an outer member which is mounted for both longitudinal and rotational displacement relative to the body, an inner member mounted axially in register with the outer member and a coupling configured to permit limited relative longitudinal movement of the outer member and the inner member and to transmit torque applied from the outer members to the inner member, the coupling including an open ended sleeve within which adjacent end portions of the inner and outer members are positioned, the retaining means acting on the sleeve to inhibit displacement thereof;

wherein the key identification means includes electronic control circuitry and communication means whereby the control circuitry can communicate with an encoded key to permit identification of the key by the control circuitry; and wherein the communication means is configured to permit wireless communication between the key and the control circuitry.

2. A lock as claimed in claim 1, in which the communication means includes at least one electrical contact which is connected to the electronic control circuitry and is mounted on the body for making contact with a complementary electrical contact on an electronically encoded key.

3. A lock as claimed in claim 1, in which the actuator arrangement is mounted for displacement, relative to the body both rotatably about an axis of rotation and longitudinally between a first position, towards which it is biased by a first biassing means, and a second position, the retaining means being displaceable, in response to a signal received from the key identification means, from a rest position, towards which it is biased, and in which it inhibits longitudinal displacement of at least part of the actuator arrangement away from its first position, to a displaced position in which it permits displacement of the actuator arrangement longitudinally to its second position.

4. A lock as claimed in claim 3, in which the sleeve and the inner and outer members have complementary formations which permit limited longitudinal displacement of the inner and outer members relative to each other and which inhibits relative rotational movement between the inner and outer members.

5. A lock as claimed in claim 4, in which the complementary formations include pins which protrude radially outwardly from the inner and outer members and are slidable in a longitudinal slot in the sleeve.

6. A lock as claimed in claim 1, in which the retaining means includes at least one displaceable locking member which, in its rest position, engages the sleeve to inhibit displacement thereof, and displacement means for displacing the locking member from its rest position to a displaced position in which it permits displacement of the sleeve.

7. A lock as claimed in claim 6, in which the displacement means includes a solenoid.

8. A lock as claimed in claim 6, in which the retaining means includes a pair of locking members.

9. A lock which includes a body;

non-mechanical key identification means; and an actuator arrangement, which is displaceable relative to the body between an inoperative condition in which it is retained releasably by retaining means linked to the key identification means and in which it is incapable of operating a device, and an operative condition in which it is capable of operating a device, at least part of the actuator arrangement being displaceable relative to the body both longitudinally between a first position towards which it is biased by first biasing means and a second position and rotatably at least when in its second position, the actuator arrangement including an outer member which is mounted on the body for both longitudinal and rotational displacement, an inner member mounted axially in register with the outer member and a coupling configured to permit limited relative longitudinal movement of the outer member and the inner member and to transmit torque from the outer member to the inner member, the coupling including an axially extending socket provided in and opening out of an end of one of the inner member and the outer member and a complementary spigot protruding axially from an end of the other of the inner member and the outer member, at least part of the spigot being positioned within the socket, the spigot being longitudinally displaceable in the socket and the coupling being configured to inhibit rotation of the spigot in the socket and thereby permit the transmission of torque from the outer member to the inner member, the spigot having a longitudinally extending recess in a surface thereof, the coupling including a retaining pin which extends transversely through the socket and the recess to inhibit rotation of the spigot in the socket.

10. A lock as claimed in claim 3, in which the first biasing means includes a first coil spring mounted in compression between the body and the outer member and urging the outer member towards a key entry point in the body.

11. A lock as claimed in claim 3, which includes second bias means urging the inner and outer members away from one another.

12. A lock as claimed in claim 11, in which the second bias means includes a second coil spring mounted in compression between the inner and outer members.

13. A lock as claimed in claim 3, in which the body includes a key entry point, longitudinal displacement of the outer member away from its first position being effected by insertion of a key into the key entry point.

14. A lock as claimed in claim 1, which includes a plurality of electrical contacts on the body, each contact being in the form of an electrically conductive pin positioned in a recess in the body.

15. A lock which includes:

a body;

an actuator arrangement which is displaceable relative to the body between an inoperative condition in which it is incapable of operating a device and an operative condition from which it is capable of operating said device;

non-mechanical key identification means;

retaining means for retaining at least part of the actuator arrangement releasably in its inoperative condition, the retaining means being linked to the key identification means and operative in response to a signal received therefrom to permit displacement of the actuator arrangement to its operative condition, the actuator arrangement including an outer member which is mounted for both longitudinal and rotational displacement relative to the body, an inner member mounted axially in register with the outer member and a coupling configured to permit limited relative longitudinal movement of the outer member and the inner member and to transmit torque applied from the outer member to the inner member, the coupling including an open ended sleeve within which adjacent end portions of the inner and outer members are positioned, the retaining means acting on the sleeve to inhibit displacement thereof;

at least one electrical contact on the body; and electrically powered components the power for which is supplied from a power source in a key, power being transmitted from a said key to the components of the lock through the at least one electrical contact on the body.

16. A lock as claimed in claim 1, which includes an internal power source.

17. A lock set comprising:

a lock which includes:

a body;

an actuator arrangement which is displaceable relative to the body between an inoperative condition in which it is incapable of operating a device and an operative condition from which it is capable of operating said device;

non-mechanical key identification means; and retaining means for retaining at least part of the actuator arrangement releasably in its inoperative condition, the retaining means being linked to the key identification means and operative in response to a signal received therefrom to permit displacement of the actuator arrangement to its operative condition, the actuator arrangement including an outer member which is mounted for both longitudinal and rotational displacement relative to the body, an inner member mounted axially in register with the outer member and a coupling configured to permit limited relative longitudinal movement of the outer member and the inner member and to transmit torque applied from the outer members to the inner member, the coupling including an open ended sleeve within which adjacent end portions of the inner and outer members are positioned, the retaining means acting on the sleeve to inhibit displacement thereof;

wherein the key identification means includes electronic control circuitry and communication means whereby the control circuitry can communicate with an encoded key to permit identification of the key by the control circuitry; and wherein the communication means is configured to permit wireless communication between the key and the control circuitry; and a complementary key.

18. A key for use in a lock set which includes:

a body;

an outer member engaging member for engaging an outer member of a said lock;

an electrical power source; and at least one external electrical contact mounted on the body for making electrical contact with a complementary contact on a said lock, wherein the outer member engaging member is rotatable relative to the body to permit displacement of the outer member engagement member relative to the at least one contact.

19. A key as claimed in claim 18, which is electronically encoded.

20. A lock as claimed claim 14, which includes electrically powered components the power for which is supplied from a power source in a key, power being transmitted from a said key to the components of the lock through electrical contacts on the body.

* * * * *